US008590734B2

(12) United States Patent
Giraud

(10) Patent No.: US 8,590,734 B2
(45) Date of Patent: Nov. 26, 2013

(54) UNITARY CONTAINER AND FLIP-TOP CAP ASSEMBLY HAVING CHILD RESISTANT SAFETY FEATURES

(76) Inventor: Jean-Pierre Giraud, Paris (FR)

( * ) Notice: Subject to any disclaimer, the term of this patent is extended or adjusted under 35 U.S.C. 154(b) by 1686 days.

(21) Appl. No.: 11/370,053

(22) Filed: Mar. 6, 2006

(65) Prior Publication Data

US 2006/0219727 A1 Oct. 5, 2006

Related U.S. Application Data

(63) Continuation-in-part of application No. PCT/US2004/028760, filed on Sep. 3, 2004.

(60) Provisional application No. 60/500,428, filed on Sep. 5, 2003, provisional application No. 60/538,596, filed on Jan. 23, 2004.

(51) Int. Cl.

| | |
|---|---|
| ***B65D 43/14*** | (2006.01) |
| ***B65D 55/16*** | (2006.01) |
| ***B65D 39/00*** | (2006.01) |
| ***B65D 55/02*** | (2006.01) |
| ***B65D 43/04*** | (2006.01) |
| *A61J 1/03* | (2006.01) |
| *B67D 3/00* | (2006.01) |

(52) U.S. Cl.

USPC ..... 220/839; 215/204; 215/224; 215/225; 215/237; 215/306; 215/295; 220/281; 220/375; 220/4.23; 222/556; 222/483

(58) Field of Classification Search

USPC ..... 220/839, 4.23, 375, 256.1, 259.1, 220/259.2, 255, 281, 254.2, 287, 263, 260; 215/341, 303, 295, 235, 237, 306, 224, 215/225, 334, 204, 216, 213, 200; 81/8.4; 222/482, 556, 483, 484

See application file for complete search history.

(56) References Cited

U.S. PATENT DOCUMENTS

| | | | | |
|---|---|---|---|---|
| 2,047,977 | A * | 7/1936 | Mcgowan | 215/329 |
| 2,079,320 | A * | 5/1937 | Kalber | 215/341 |

(Continued)

FOREIGN PATENT DOCUMENTS

| | | |
|---|---|---|
| DE | 8532151 | 1/1986 |
| EP | 0084617 | 8/1983 |

(Continued)

OTHER PUBLICATIONS

Japanese Patent Office, Official action mailed Jun. 8, 2010, in Japanese Patent Application No. 2006-526197.

(Continued)

*Primary Examiner* — J. Gregory Pickett
*Assistant Examiner* — Mollie Llewellyn
(74) *Attorney, Agent, or Firm* — McAndrews, Held & Malloy, Ltd.

(57) ABSTRACT

A child-resistant lift-off cap for a container is adapted to be difficult to unseat independently to open the container. An overlay portion associated with the cap is adapted for use to lift the cap from a container to unseat it. The overlay portion has a thumb tab and is deformable to engage and lift the seated cap only when the thumb tab is lifted. The overlay portion raises independently of the cap when the deformable portion is not deformed into engagement with the cap. Alternatively, a lift-top cap having a slot through it, the slot having a first opening near an edge of the cap to be lifted to unseat the cap and a second opening. A slide in the slot has a first end biased to be flush with or recessed into the first opening and a second end biased to normally protrude out of the second opening. The second end of the slide can be depressed against the bias of the slide to displace the first end of the slide out of the first opening to function as a thumb tab to assist in lifting the cap from a container.

4 Claims, 7 Drawing Sheets

(56) References Cited

U.S. PATENT DOCUMENTS

| | | | | |
|---|---|---|---|---|
| 3,749,272 | A * | 7/1973 | Brockett et al. | 215/341 |
| 3,811,590 | A * | 5/1974 | Hall, Jr. | 215/207 |
| 4,337,869 | A * | 7/1982 | Guinle | 215/201 |
| 4,442,735 | A * | 4/1984 | Chance et al. | 81/3.44 |
| 4,444,326 | A | 4/1984 | Musel et al. | |
| 4,783,056 | A | 11/1988 | Abrams | |
| 4,925,041 | A | 5/1990 | Pehr et al. | |
| 5,462,183 | A | 10/1995 | Rohr et al. | |
| 6,080,350 | A | 6/2000 | Hekal | |
| 6,382,476 | B1 * | 5/2002 | Randall et al. | 222/545 |
| 6,640,665 | B1 * | 11/2003 | Williamson | 81/3.4 |

FOREIGN PATENT DOCUMENTS

| | | |
|---|---|---|
| JP | 09-012064 | 1/1997 |
| WO | WO97/37900 | 10/1997 |
| WO | WO9749615 | 12/1997 |

OTHER PUBLICATIONS

International Search Report and Written Opinion of International Search Authority, PCT/US2004/028760 (Mar. 30, 2005).

Communication pursuant to Article 96(2) EPC (Feb. 3, 2007).

* cited by examiner

UNITARY CONTAINER AND FLIP-TOP CAP ASSEMBLY HAVING CHILD RESISTANT SAFETY FEATURES

RELATED APPLICATIONS

This application is a continuation-in-part of PCT application PCT/US2004/028760 to Jean-Pierre Giraud, filed 3 Sep. 2004, entitled, "Unitary Container and Flip-Top Cap Assembly Having Child Resistant Safety Features," designating the United States, which claims priority to U.S. provisional application Ser. No. 60/500,428, entitled, "Unitary Container and Flip-Top Cap assembly Having Child Resistant Safety Features," to Jean-Pierre Giraud, filed Sep. 5, 2003, and U.S. provisional application Ser. No. 60/538,596, entitled, "Unitary Container and Cap Assembly with Sliding Part for Child Resistance," to Jean-Pierre Giraud, filed Jan. 23, 2004.

PCT Published Application WO 2005/026013 A2 (corresponding to PCT/US2004/028760) and all the applications identified in the preceding paragraph are hereby incorporated by reference in their entireties to provide continuity of disclosure.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to child-resistant safety caps and containers with such caps.

There is an increasing awareness of the need to protect children from inadvertently gaining access to medications, especially prescribed medications. Sometimes, ingestion of only one or two pills of a prescribed medication will prove fatal to a child. Moreover, there is an increasing awareness of the necessity to provide containers for prescribed medications that are readily and easily opened by a person of responsible age, that is, any person having the cognitive ability to understand the instructions for opening a pill container, which requires certain manipulation and manual dexterity. Such persons are assumed, as well, to have the ability to understand that the act of opening a pill container to gain access to the prescribed medication is a deliberate action, and is only undertaken when there is a necessity to attain access to the prescribed medication in the pill container.

There are several conventional, so-called, "childproof" or "child-resistant" pill containers and bottles in the market, which are generally employed by dispensing pharmacists for use in filling prescriptions, where the prescription requires that the pharmacist dispense one or more of a plurality of pills, tablets, gel-caps, capsules, or the like, or a quantity of a liquid medicine. For example, the container may include a "push-and-turn" closure for pill containers, or an "arrow-alignment" closure for pill containers.

The "push-and-turn" system for pill containers conventionally refers to a system in which the closure or cap for the pill container must be pushed axially downwardly and rotated at the same time to open the container. The "arrow alignment" system for pill containers conventionally refers to a system in which an arrow on the closure or cap must be aligned with an arrow on the pill container, such as one which is embossed on the container, in order to open the container. However, these containers are often complicated for adults to use.

Conventional container assemblies, whether or not of the type where the cap or closure is tethered to the container, may have a fixed protrusion (also referred to as a "thumb tab") attached to the cap that is configured to assist in the opening of the cap. More typically, this fixed protrusion is opposite the hinge, and thus, acts as a lever to allow the intended user to open the container when a sufficient force is applied under the fixed protrusion.

However, these containers are easily opened by a child.

Therefore it is an object of the invention to provide an improved container and cap system which is child resistant, yet easily opened by an adult.

BRIEF SUMMARY OF THE INVENTION

One aspect of the invention is a child-resistant lift-off cap for a container. The cap is adapted to be difficult to unseat independently to open the container, except by using an overlay portion attached to the cap and adapted for use to lift the cap from a container to unseat it. The overlay portion has a thumb tab and is deformable to engage and lift the seated cap only when the thumb tab is lifted. The overlay portion raises independently of the cap when the deformable portion is not deformed into engagement with the cap.

In an embodiment, not limiting the scope of the invention, the overlay fits over at least a portion of the cap's solid base. At an end of a first portion of the overlay, the overlay has a thumb tab for facilitating the opening and closing of the cap. Two notches are in the overlay's tubular skirt and located on opposing sides of the overlay where the first end portion meets the second end portion. When the cap is shut, the overlay is secured directly over the cap. If an upward force is only applied to the thumb tab, and then the first end portion of the overlay is lifted up, and the solid base of the cap remains secured to the container. If an upward force is applied to the thumb tab while simultaneously, sufficient inward force is applied to opposing sides of the overlay so as to contact and secure the tubular skirt of the cap, then the solid base is of the cap is simultaneously lifted up along with the first end portion of the overlay, thereby opening the container.

Another aspect of the invention is a lift-top cap having a slot through it, the slot having a first opening near an edge of the cap to be lifted to unseat the cap and a second opening. A slide in the slot has a first end biased to be flush with or recessed into the first opening and a second end biased to normally protrude out of the second opening. The second end of the slide can be depressed against the bias of the slide to displace the first end of the slide out of the first opening to function as a thumb tab to assist in lifting the cap from a container.

In an embodiment, not limiting the overall invention, a container and cap assembly contains a sliding part in the cap. The sliding part may be supplied separate from the container and cap assembly, allowing the user to determine if a child-resistant or non-child resistant cap is formed. In the child resistant embodiment, the sliding part is configured within the cap whereby at least a portion of the sliding part protrudes out from the cap in a location near or proximate to the hinge. To open the cap, the user applies sufficient force to the sliding part, pushing it in a direction away from the hinge so that at least a portion of the sliding part protrudes out of the portion of the cap that is substantially opposite the hinge.

Embodiments of the invention can be made so the same parts can be assembled in a child-resistant or a non-child resistant orientation.

DETAILED DESCRIPTION OF THE INVENTION

Definitions

Figure 1C:
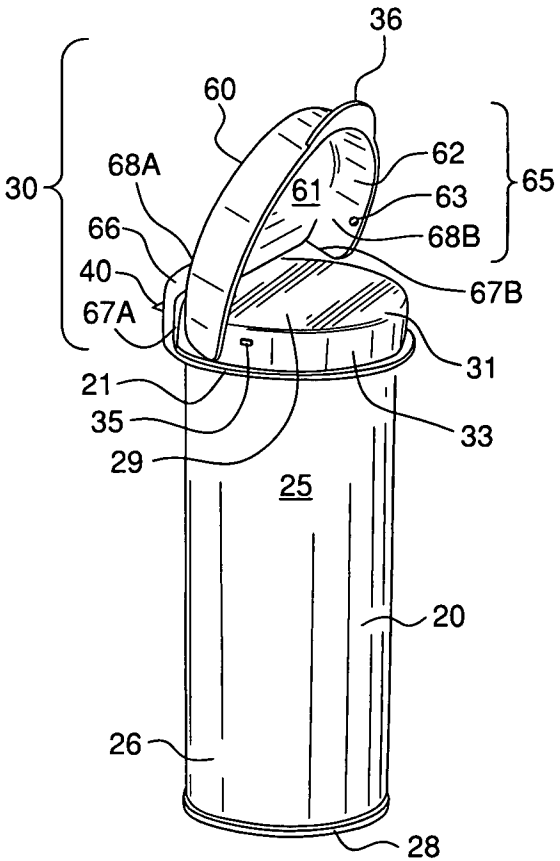
FIGS. 1A, 1B and 1C are perspective views of an embodiment of a container and cap assembly.
Figure 1B:
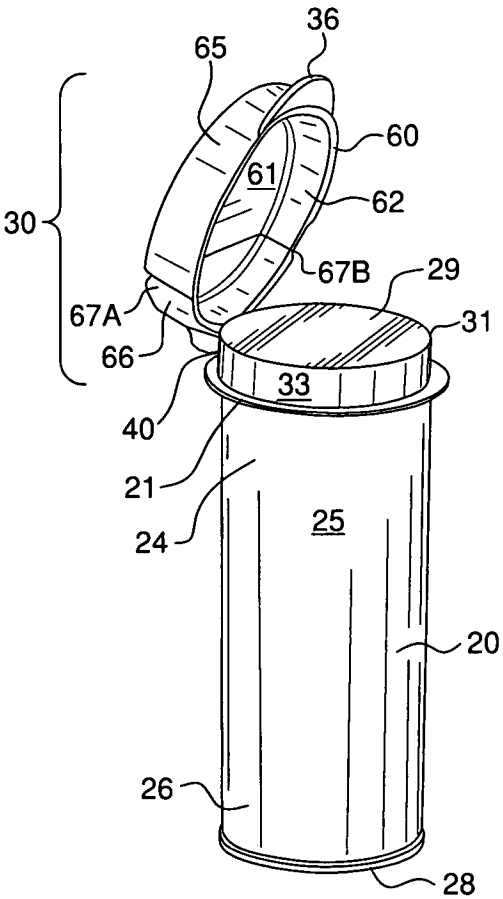

As generally used herein, a "child-resistant" cap or closure for a pill container means that the cap or closure meets the following standard.

When a child-resistant package is tested by a group of children under five years old, the child-resistant package cannot be opened by at least 85% of those children prior to a demonstration to them of the proper means of opening the package; and still cannot be opened by at least 80% of those children after they receive a demonstration of the proper means for opening the package. In the case where a child-resistant package is provided to a test group of adults, at least 90% of those adults must be capable of opening the package. Where the package is designed so that it may be re-closed, it can be re-closed by at least 90% of those adults but still cannot be opened by at least 85% of children to whom no demonstration of the proper method of opening the package has been given, nor by 80% of those children after a demonstration has been made.

As generally used herein, "moisture-tight" means the moisture ingress of the container after three days is less than about 750 micrograms of water, preferably, about 250 micrograms of water, more preferably, about 150 micrograms of water determined by the following test method: (a) place 0.25 grams of molecular sieve in the container and record the weight; (b) fully close the container; (c) place the closed container in an environmental chamber at conditions of 80% relative humidity and 72° F. (22° C.); (c) after one day; weigh the container containing the molecular sieve; (d) after four days, weigh the container containing the molecular sieve; and (e) subtract the first day weight of the sample from the fourth day weight of the sample to calculate the moisture ingress of the container in units of micrograms of water.

Container and Cap Assembly

The container may have any shape that is suitable for storing medicaments or other objects to be kept out of the hands of young children. The container may, in an embodiment, be a bottle, jar, jug, or other type of container intended for solid or liquid contents. Such containers commonly have a generally cylindrical neck or top portion defining an opening. In an embodiment, the container is in the shape of a cylinder. Typically, the container is closed at one end and is open at the opposite end. Optionally, the container is open at both ends. Optionally, when the container is closed, the container is moisture tight.

The cap can be attached to the container by way of a hinge, defining a flip-top cap. The cap also can have a mating sealing element that interfaces with the open end of the container, thereby forming a container and cap assembly.

The assembly is preferably molded of plastic. Suitable material for the assembly includes plastics like thermoplastics such as polypropylene and polyethylene. The assembly may be produced in accordance with the operation disclosed in U.S. Pat. No. 4,783,056 to Abrams, RE37,676 to Abrams et al. or U.S. Pat. No. 6,303,064 to Abrams et al. The disclosures of these patents are incorporated herein by reference.

Optionally, the container includes a lining of a material that absorbs or releases materials. As an example, if the material absorbs water vapor, it may be included to keep the contents at a low relative humidity since any moisture that permeates through the seal or is present in the container would be absorbed. The lining material may be a desiccant entrained plastic.

Suitable desiccant plastics include, but are not limited to those disclosed in U.S. Pat. Nos. 5,911,937; 6,214,255; 6,130,263; 6,080,350; 6,174,952; 6,124,006; and 6,221,446, all to Hekal. These disclosures of these patents are incorporated herein by reference. The lining may also release a gas, such as an inert gas that prevents oxidation of the enclosed medicament, a flavoring or fragrance, or moisture, in the case of a medicament that should not be allowed to dry out.

Cap With Overlay

Figure 1A:
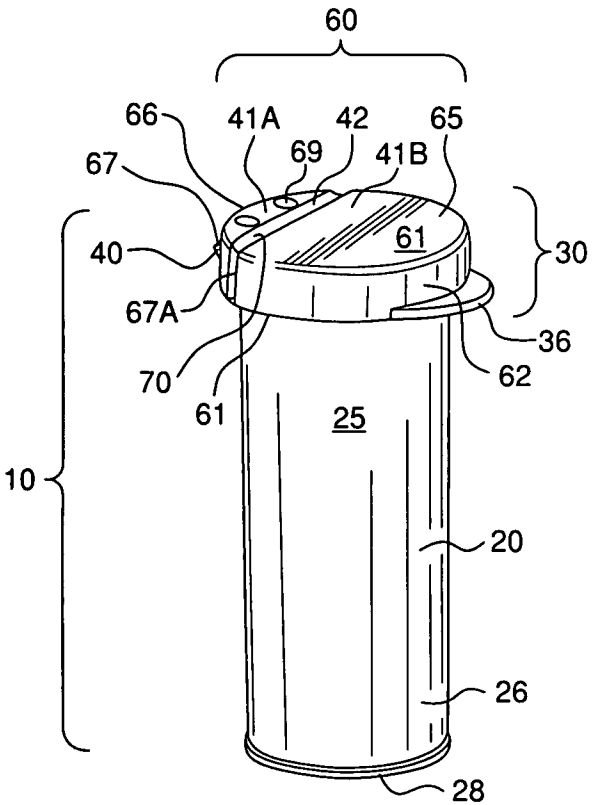

One embodiment of the child resistant container and cap assembly is depicted in FIGS. 1A-6B. As depicted in FIGS. 1A-1C, the assembly 10 includes a container 20 having a base 28, an internal cavity 27 (see FIGS. 3B and 3C), an outer surface 25, a flange 21, a lip 22 (see FIG. 5), and a lower portion 26.

The assembly 10 also has a two-part cap 30 including an inner cap 31 and an outer cap 60. The inner cap or solid base 31 has a web 29 overlying and closing the container when the cap 30 is fixed to the container 20 and a skirt 33 extending perpendicularly from the web 29 and overlying the lip 22 of the container 20 to close the container. The inner cap 31 can be removably secured to the container 20 in a variety of ways, for example, by providing a beaded lip 22 of the container 20 and a corresponding circumferential groove 32 in the inner side of the tubular skirt 33, similar to the arrangement illustrated in FIG. 8 and further described below. The illustrated arrangement is a conventional interference fit of the cap on the container, providing a tight seal. Other seating and sealing arrangements can also be used. The cap 30 may be a flip-top cap with a hinge, as illustrated, in an embodiment. Other types of caps can also be used.

In an embodiment, the inner cap 31 fits tightly on the lip 22, and has no provision such as a thumb tab or pad or a friction surface to allow an ordinary user, or at least a young child, to get a sufficient grip on the inner cap to easily unseat and open it without using the outer cap or overlay 60 as explained below.

The cap 30 also includes a second, outer cap or overlay 60, which is equipped to capture and lift the inner cap 31 when manipulated in a certain way as explained below; the outer cap 60 is used to unseat the inner cap 31 and thus open the container 20. The overlay 60 has a base 61 with an outer periphery and a skirt 62 extending over the outer periphery of the base. The overlay is sized to fit over at least a portion of the cap's solid base 31 and tubular skirt 33, so the skirts 33 and 62 are at least nearly concentric, with a small clearance between them, in an embodiment.

The overlay 60 has a first or flap portion 65 and a second portion 66. An overlay hinge 70 (see e.g. FIG. 4) connects the first portion 65 with the second portion 66 of the overlay. In an embodiment, at the end of the first portion 65 opposite the overlay hinge 70, the overlay has a thumb tab 36 for facilitating the opening and closing of the outer cap.

The second portion 66 of the overlay 60 covers the area of the inner cap 31 near the hinge 40. Optionally, the second portion 66 can be attached to or integral with the inner cap 31, as by joining them with ultrasonic welds Z, molding them as a single part, joining them with adhesive or a fastener, providing an interference fit, or in other ways. The overlay 60 can also be provided as a separate part.

Figure 2C:
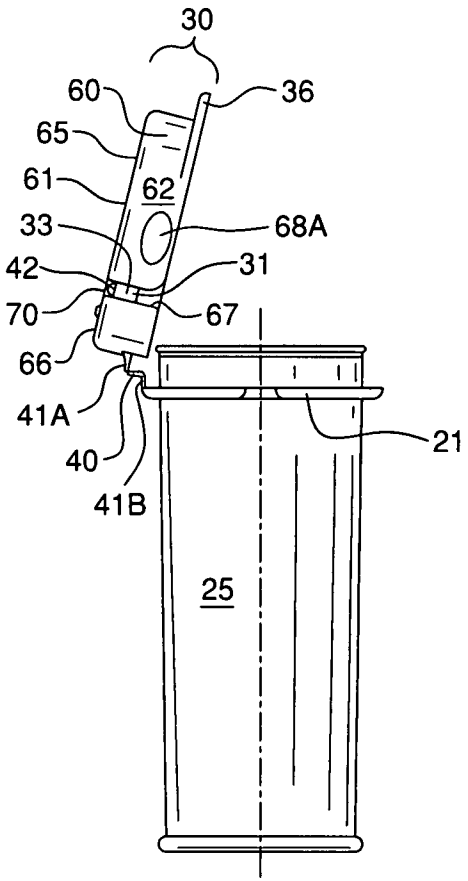
FIGS. 2A, 2B and 2C are elevations of the same embodiment.
Figure 2B:
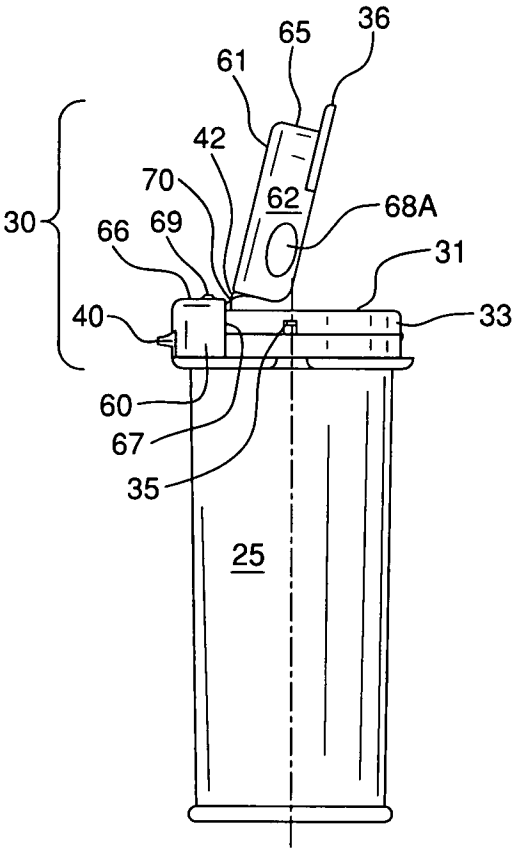
Figure 2A:
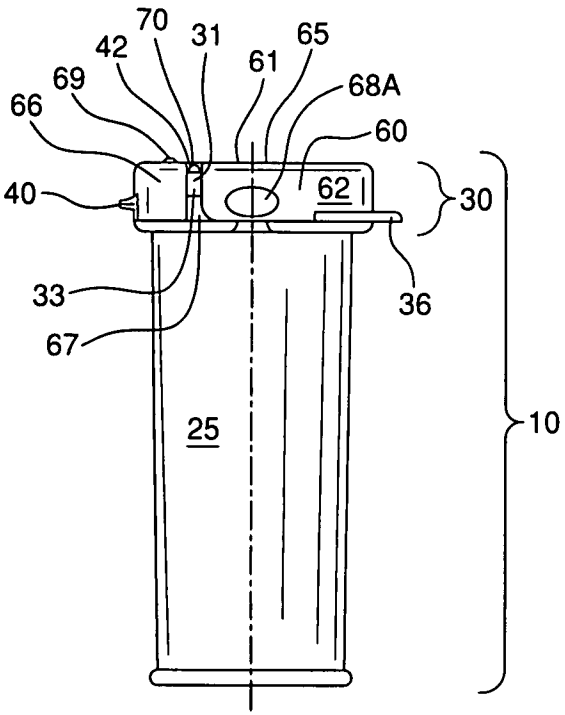
Figure 3C:
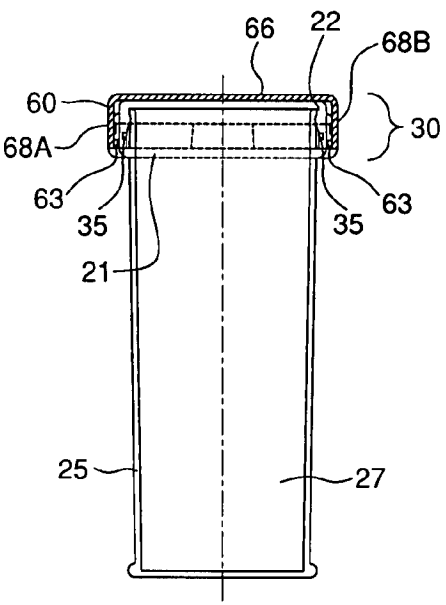
FIGS. 3A is a side elevation and FIGS. 3B and 3C are longitudinal sectional views of the same embodiment, viewed respectively from the side and from the rear.
Figure 3B:
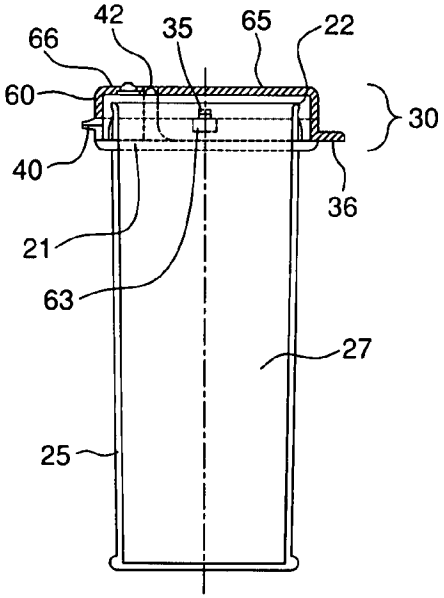
Figure 3A:
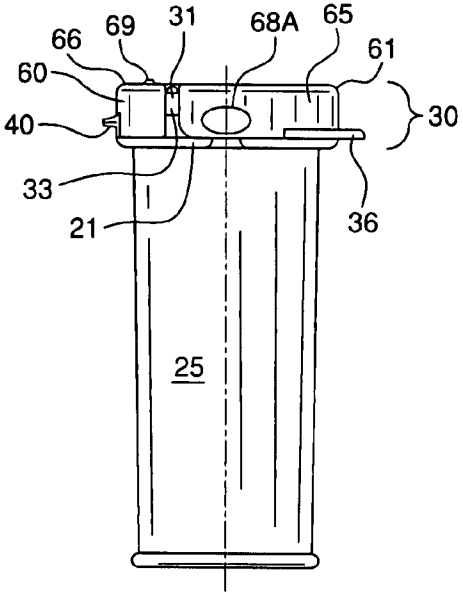
Figure 4:
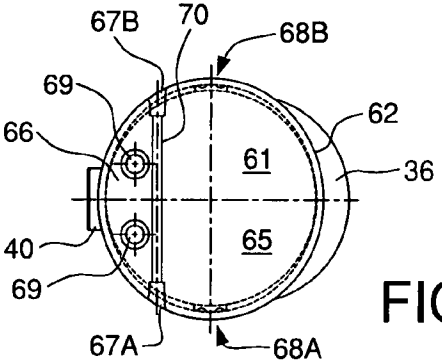
FIG. 4 is a top plan view of the same embodiment.
Figure 5:
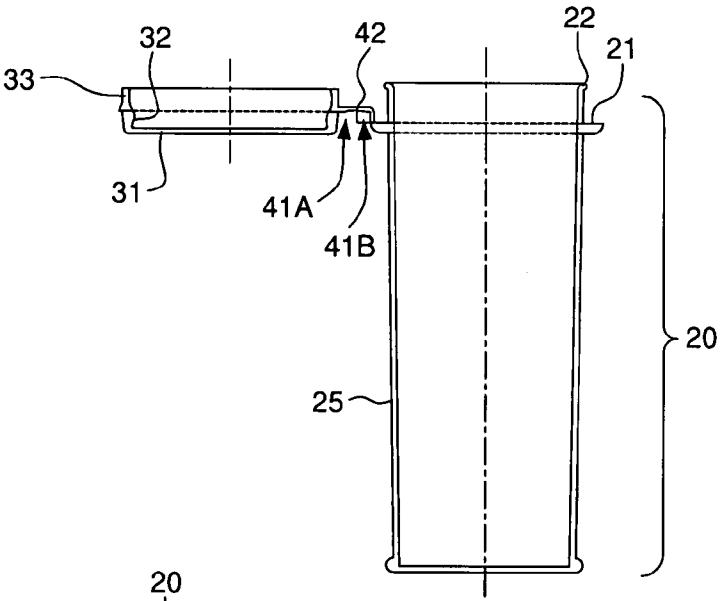
FIG. 5 is a sectional view similar to FIG. 3B, but with the cap in an open position.
Figure 6B:
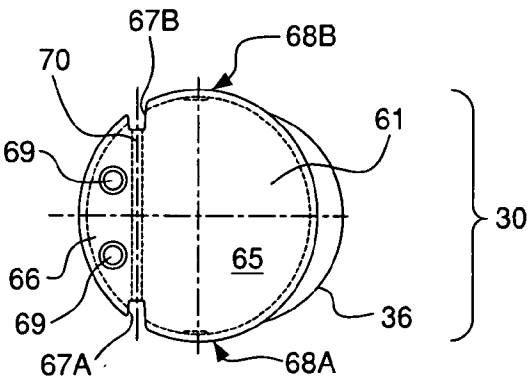
FIG. 6B is a top plan view of the same embodiment in a closed position.
Figure 6A:
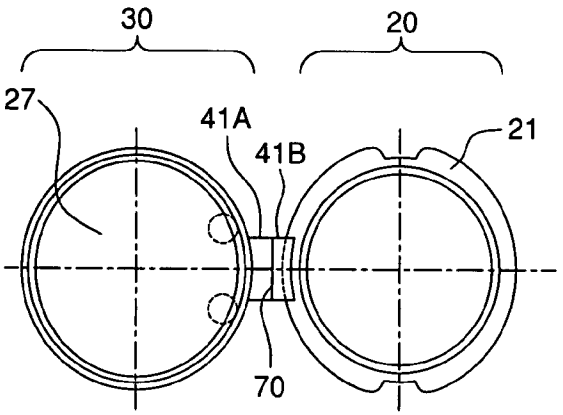
FIG. 6A is a top plan view of the same embodiment, with the cap in an open position.

In an embodiment, with the reference to FIGS. 1C and 3B, the outer surface of the skirt 33 and the inner surface of the skirt 62 of the first part 65 of the overlay portion or outer cap 60 can have complementary parts, such as a lug 35 on the outside surface of the skirt 33 and a lug 63 on the inside surface of the skirt 62, or a lug in one part and a recess in the other, or roughened or grooved or toothed portions, that can selectively be engaged by squeezing or pressing the skirt 62 radially inward in one or more places, but that do not engage if the skirt 62 is not manipulated inward. These complementary parts can be located in various places, such as near the thumb tab 36 or, as illustrated in FIGS. 2A-C and 4, within the finger pads 68A and 68B, provided to show the user where to grasp the skirt 62. In an embodiment, the force needed to press the skirt 62 inward can be reduced by providing a tab formed integrally with the skirt 62 but only joined to the balance of the skirt along part of its perimeter.

Optionally, the container also has a flange 21 projecting radially outwardly from the outer surface 25 of the container 20, against which the outer cap 60 and/or the inner cap 31 can seat. The hinge 40 may also be attached to the container flange 21.

In an embodiment, the hinges 40 and 70 may be conventional integral hinges. The overlay hinge 70 may have a recess 42 that functions as a bending point during the opening and closing of the container.

In an embodiment, the recess 42 is characterized by a relatively thinner section of plastic material which bridges thicker sections 41A and 41B. The recess 42 bends relatively easily so the first or flap portion 65 of the outer cap 60 can lay flat against or near the inner cap 31 or flex away from the inner cap 31. In the hinge 40, similar construction can be used, in an embodiment.

When the two-part cap 30 is shut, the inner cap 31 is seated on the container and the overlay 60 is positioned directly over the inner cap 31, in an embodiment. If an upward force is only applied to the thumb tab 36, then the first portion 65 of the overlay is lifted up and bends at the overlay hinge 70. This lifting force does not engage the lugs 35 and 63 of the skirts 33 and 62. Thus, when the flap portion 65 of the overlay is lifted it does not engage the inner cap 31, the inner cap 31 remains secured to the container 20, and the container remains closed, as shown in FIG. 2B.

As shown in FIG. 2C, if an upward force is applied to the thumb tab 36 while, simultaneously, a sufficient inward force is applied to the skirt 62 of the flap portion 65 of the overlay 60 to engage the complementary parts such as the lug 35 projecting outward from the skirt 33 and the lug 63 projecting inward from the skirt 62 (see especially FIG. 3B, showing the lugs 35 and 63), then the inner cap 31 is simultaneously lifted up along with the entire overlay 60, resulting in the container 20 being opened. In an embodiment, the inner cap 31 remains nested within the overlay 60 when the container is opened.

In an embodiment, two sets of the lugs 35 and 63 can respectively be located near the grip area 68A and a corresponding diametrically opposed grip area 68B of the skirt 62. The grip areas 68A and 68B can be pinched together with one hand to engage the respective sets of lugs, so the inner cap is lifted when the outer cap is raised using the thumb tab 36.

In the same or another embodiment, the lugs 35 and 63 can be located within the skirt 62 in proximity to the thumb tab 36, so an inward force can be applied just at that part of the skirt 62 while an upward force is applied to the thumb tab 36.

A "sufficient force" is a force above a threshold that causes the lugs 63 of the opposing sides 68A and 68B of the overlay 60 to contact and engage the lugs 35 projecting outward from the tubular skirt 33 of the inner cap 31, and allow the solid base 31 of the cap to be simultaneously lifted up along with the first portion 65 of the overlay resulting in an open container. Children who are too young to comprehend the dangers of taking medicines unintended for them, or large doses of medicines, do not generally possess the strength necessary to apply a force at or above the threshold.

A person of ordinary skill in the art would understand how to construct opposing sides 68A and 68B of the overlay 60 that bends only upon application of a sufficient force. In one embodiment, the cap includes a suitable amount of elastomer in the thermoplastic formulation used to construct opposing sides 68A and 68B. In another embodiment, the dimensions of the closure are selected to make a certain force sufficient.

The degree of coverage of the overlay 60 over the solid base 31 may vary from what is shown in the Figures, as long as the overlay serves the desired function. In an embodiment, the overlay is of a suitable size and construction so that only the first portion 65 is lifted, if only an upward force is applied to the thumb tab, and both the overlay 60 (including both the first portion 66 and second portion 65) and the solid base 31 are lifted, if sufficient inward force is applied to 68A and 68 B while an upward force is applied to the thumb tab.

In an embodiment, the second portion 66 is secured or tethered to the solid base 31 in any suitable way, temporarily or permanently, so the second portion 66 remains secured to the solid base 31 when a force is applied only to the thumb tab. Suitable methods of securing include molding, co-molding, in-mold and adhesion methods. In an alternative embodiment, the second portion 66 can be omitted.

Notches 67A and 67B (FIG. 4) may be any suitable size that does not prevent the first or flap portion 65 from sufficiently bending when a force is applied to the thumb tab but insufficient or no inward force is applied to 68A and 68 B.

The degree of force that is required to lift the second portion 66 can be varied based on at least the following: the material of construction, the size of the notch, the locations of the engaging parts of the inner cap 31 and overlay 60, the shape and depth of the recess, the size of the thumb tab, and other factors.

Cap With Sliding Part

FIGS. 7-10 show a second embodiment of the invention in which the container and cap assembly 80 contains a sliding part 82 in the cap 84 that travels in the slot 86. A kit containing the container and cap assembly 80 and the sliding part 82 may be provided in an unassembled form (see FIG. 9).

Figure 8:
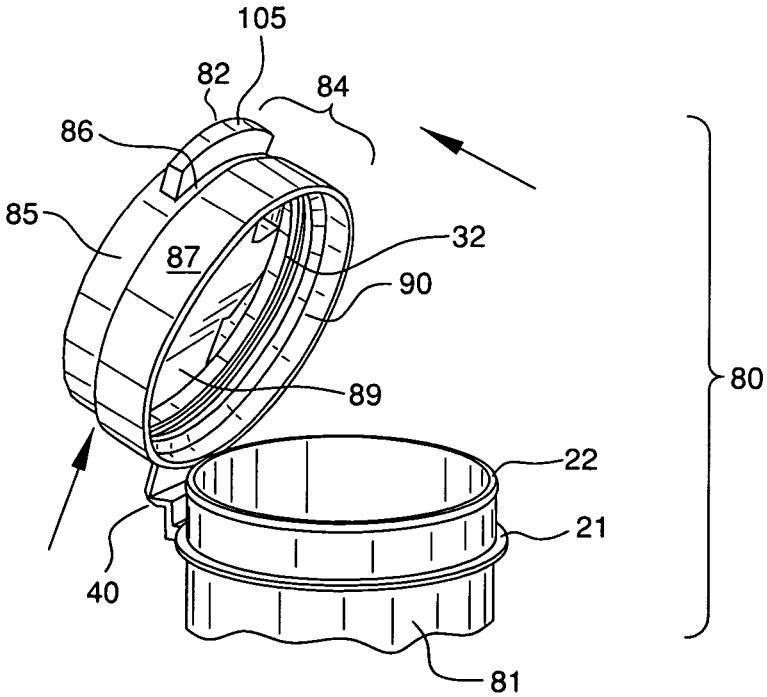
FIG. 8 is a perspective view similar to FIG. 7, but showing the sliding element advanced according to the lower arrow and the cap lifted to the open position according to the upper arrow.

In an embodiment, shown best in FIG. 8, the assembly 80 comprises a container 81 and a cap 84. The container 81 has a beaded upper lip 22 and a circumferential flange 21, which may be similar to the corresponding parts of FIGS. 1-6.

In an embodiment, the cap 84 has an upper portion 85 having a slot 86 passing through it and a lower portion 87 similar to the inner cap 31. The lower portion 87 has a web 89 and a skirt 90. The lower portion 87 can be removably secured to the container 20 in a variety of ways, for example, by providing a beaded lip 22 of the container 20 and a corresponding circumferential groove 32 in the inner side of the tubular skirt 90. To seat the cap 84 on the container 20, the skirt 90 is pressed onto the bead of the lip 22 to advance the groove 32 of the skirt 90 over the bead of the lip 22, capturing the bead Y in the groove 32 and positively holding the cap 84 in its seated position against the lip 22. The illustrated arrangement is a conventional interference fit of the cap on the container, providing a tight seal. Optionally, the container is moisture tight when it is closed. Other seating and sealing arrangements can also be used. In an embodiment, the cap 84 is adapted to fit tightly and to have a relatively low friction outer surface without projections so it is not easily opened without assistance from the sliding part 82 as described below. The cap 84 may be a flip-top cap with a hinge, as illustrated, in an embodiment. Other types of caps can also be used.

Figure 10:
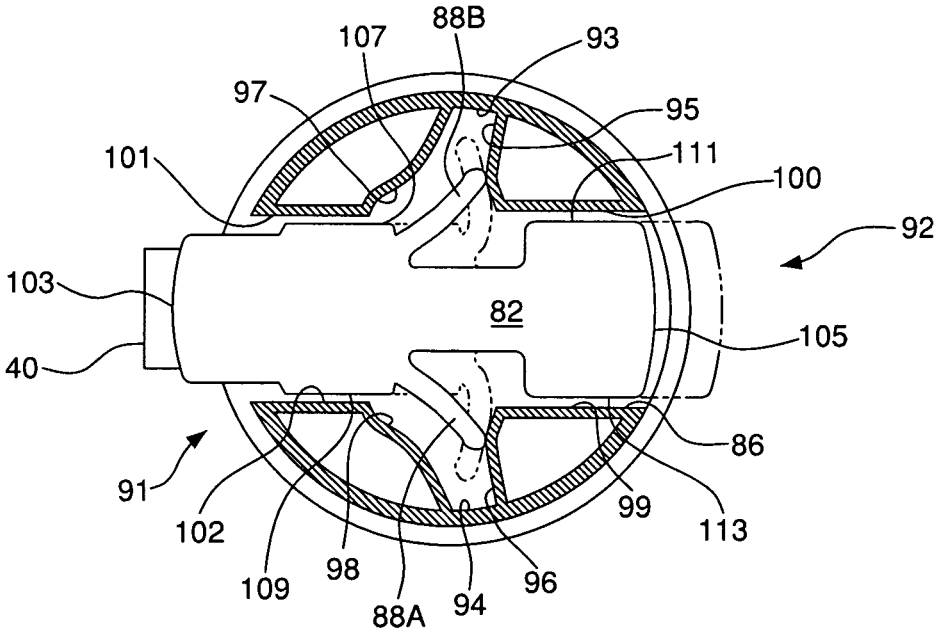
FIG. 10 is a radial section taken along section line 10-10 of FIG. 7, through and in the plane of the slide 82 and slot 86, showing the slide 82 in its child-resistant orientation, at rest in full lines and advanced against its bias to present a thumb tab in phantom lines.

The slot 86 has a first opening 91 on the hinged side of the cap 84 and a second opening 92 at the swinging side of the cap 84. Referring to FIG. 10, side pockets 93 and 94 extend laterally from the slot 86. The side pockets 93 and 94 define primary bearing surfaces 95 and 96 and alternate bearing surfaces 97 and 98. The slot 86 is further defined by guide surfaces 99, 100, 101, and 102.

The sliding part 82 has resilient spring leaves 88A and 88B, a first end 103, a second end 105, and guide projections 107, 109, 111, and 113.

Figure 7:
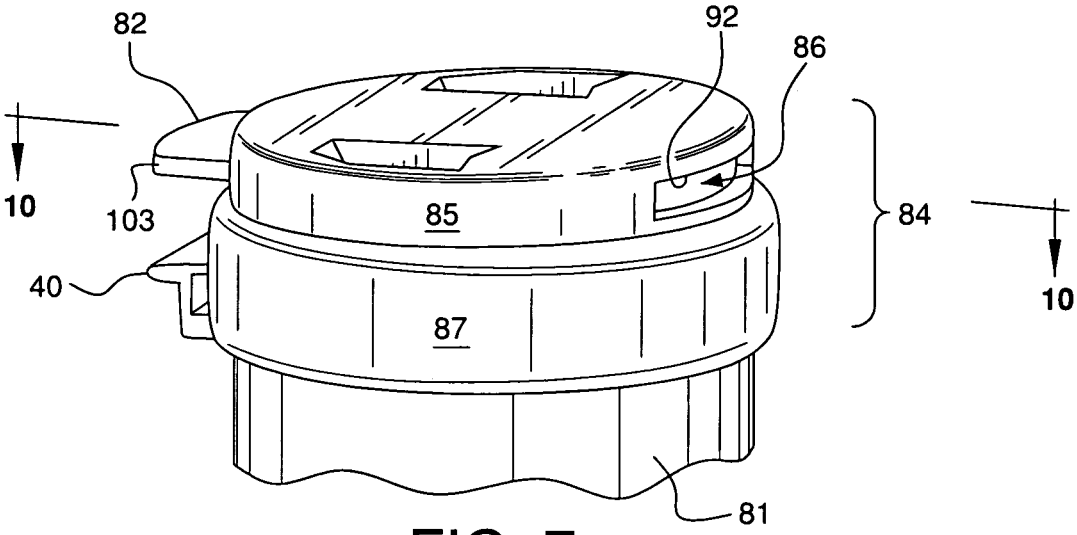
FIG. 7 is a perspective view of the top portion of a container according to another embodiment, showing a cap in the closed position containing a sliding element 82 withdrawn into the cap on the right side and protruding on the left side.

Referring to FIGS. 7 and 10, to make the container child-resistant, the end 103 of the slide 82 is inserted into the opening 92 of the slot 86. The slide 82 is advanced into the slot 86 far enough that the resilient spring arms 88A and 88B are folded laterally inward by contact with the guide surfaces 99 and 100, and still further into the slot 86 so the resilient spring arms 88A and 88B spring back out to their relaxed positions in the pockets 93 and 94.

In an embodiment, the spring arms 88A and 88B capture the slide 82 in the slot 86 by acting as barbs bearing against the primary bearing surfaces 95 and 96, preventing the slide 82 from being withdrawn. In this embodiment, the opening 91 of the slot 86 can optionally be made too small to pass the guide projections 107 and 109, so the slide 82 cannot be withdrawn from the slot 82 through the opening 91, either. This embodiment is useful to prevent the slide 82 from being removed and possibly subsequently lost (making the container difficult for anyone to open without a tool) or ingested by a child.

When the spring arms are in the pockets 93 and 94, the end 105 of the slide 86 is essentially retracted essentially flush with or into the opening 92, so it does not function as a thumb tab to assist the user in opening the container 81. The spring arms 88A and 88B bear against the primary bearing surfaces 95 and 96 if the slide 82 is advanced out of the opening 92, thus biasing the slide 82 to its retracted position. When the slide 82 is in its retracted position, the end 103 protrudes out of the slot opening 91.

Referring to FIGS. 7 and 8, to open the container when in the child-resistant configuration of FIG. 7, the slide 82 is advanced against its bias by pushing in on the end 103, shown by the lower left arrow in FIG. 8. This advances the end 105 of the slide 82 out of the opening 92, presenting the end 105 as an accessible thumb tab, as shown in FIG. 8. While manually holding in the end 103 in against its bias, as with the thumb of one hand, the thumb tab 105 can be lifted as shown by the upper right arrow in FIG. 8, as with the thumb of the other hand, to unseat the cap 84 and open the container. When sufficient force is applied in two perpendicular directions, the user is able to open the cap.

The sliding part 82 returns to its original position when the user releases the force on it. Upon retraction, at least a portion of the sliding part 82 protrudes out from the hinge side of the cap 84 in a location near or proximate to the hinge 40 and substantially no sufficient portion of the sliding part protrudes out of the portion of the cap 84 that is substantially opposite the hinge to allow the container to be opened easily.

In another embodiment, the spring arms 88A and 88B can be adapted not to capture the slide 82 in the slot 86, or the opening 91 of the slot 86 can optionally be made large enough to pass the guide projections 107 and 109, so the slide 82 can be withdrawn from the slot through the opening 91. This embodiment has the advantage of allowing the user the option to either insert the slide 82 into place from the slot opening 92, to make it child-resistant, or from the slot opening 91, to make it non-child-resistant and thus easier for a person having limited hand strength or dexterity to open it. If the slide 82 is inserted into the slot opening 91, with the leading end 103 foremost, the spring arms 88A and 88B will spring into the pockets 93 and 94 in the opposite orientation, bearing against the alternate bearing surfaces 97 and 98 and thus biasing the end 103 of the slide 82 to normally protrude from the opening 92, allowing it to function as a thumb tab when opening the container 81 without the need to manipulate the slide 82 against its bias. Also, in this embodiment the alternate bearing surfaces 97 and 98 can be shaped as shown in FIG. 10, which bias the slide as described above for the non-child-resistant orientation.

Thus, in an embodiment the consumer can determine whether or not the child resistant feature is needed. The consumer can insert the sliding part 82 in the desired direction to form a child resistant cap or a non-child resistant cap. When assembled, the sliding part is inserted into the slot such that sliding part and slot are in parallel alignment and the sliding part extends longitudinally inside the slot.

Figure 9:
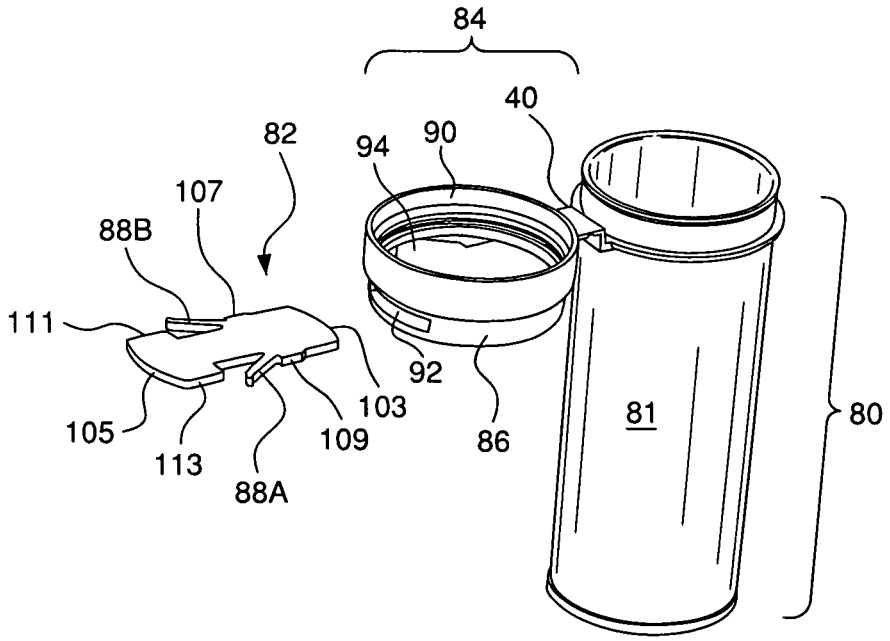
FIG. 9 is an illustration of a kit of the parts shown in FIG. 7, containing a sliding element and a container with a cap with a space for a sliding element.

FIG. 9 illustrates one embodiment of the unassembled sliding part 82 in relation to the integral cap and container assembly 80.

In the non-child resistant embodiment, not shown, the sliding part is inserted in the opening in the slot 86 that is on the side of the hinge. At least a portion of the sliding part 82 protrudes out from the cap 84 in a location substantially opposite from the hinge 40. Then, the user is able to open the cap by merely applying an upward force on the portion of the sliding element that extends outside of the cap 84.

Optionally, the slot in the cap is above a continuous web or surface 89 defining the underside of the cap 90 so that it does not affect the moisture-proof characteristics of the container assembly.

In an embodiment, the container assembly 80 may be produced a two shot injection molding process or an in mold liner process. Optionally, the container assembly may be produced by assembling a molded container and a sleeve either automatically or manually.

Those skilled in the art will recognize, or be able to ascertain using no more than routine experimentation, many equivalents to the specific embodiments of the invention described herein. Such equivalents are intended to be encompassed by the following claims.

What is claimed is:

1. A child-resistant lift-off cap assembly attached to a container by a hinge and having a generally cylindrical neck or top portion defining an opening, the assembly comprising:

A. a lift-off cap adapted to seat with respect to the container to close it the container; and B. an overlay portion attached to the cap and adapted for use to lift the cap from the container to unseat the cap, the overlay portion comprising a thumb tab and a skirt, the thumb tab configured to outwardly extend from the skirt, the skirt including a deformable portion overlying the seated cap when the overlay is in a seated position, an outer portion of the deformable portion positioned on an exterior surface of the skirt and adapted to be depressed by a user to deform the deformable portion into engagement with the cap, the overlay portion being adapted to engage and lift the seated cap only when the outer portion of the deformable portion is depressed by the user into engagement with the cap and the thumb tab is lifted, and to raise independently of the cap from the seated position when the deformable portion is not deformed into engagement with the cap.

2. A cap assembly on a container, the assembly comprising an overlay attached to the container by a hinge and a cap, the overlay comprising a thumb tab and a skirt, the thumb tab configured to extend from the skirt, the skirt including a deformable portion overlying the cap, the deformable portion deformable by depressing an exterior surface of the skirt to engage the cap, the overlay being adapted to engage and lift the cap from a seated position on the container only when the deformable portion is deformed into engagement with the cap and the thumb tab is lifted, and to raise independently of the seated cap when the deformable portion is not deformed into engagement with the cap.

3. The assembly of claim 2, wherein the container is a cylinder.

4. The assembly of claim 2, seated in moisture-tight relation on the container.

* * * * *

UNITED STATES PATENT AND TRADEMARK OFFICE

CERTIFICATE OF CORRECTION

PATENT NO. : 8,590,734 B2
APPLICATION NO. : 11/370053
DATED : November 26, 2013
INVENTOR(S) : Giraud It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1891 days.

Signed and Sealed this
Twenty-first Day of April, 2015

Michelle K. Lee

Michelle K. Lee
*Director of the United States Patent and Trademark Office*